US006411041B1

(12) United States Patent
Parra

(10) Patent No.: US 6,411,041 B1
(45) **Date of Patent: *Jun. 25, 2002**

(54) NON-THERMIONIC FLUORESCENT LAMPS AND LIGHTING SYSTEMS

(76) Inventor: Jorge M. Parra, 10721 Skyhawk Dr., New Port Richey, FL (US) 34654

( * ) Notice: Subject to any disclaimer, the term of this patent is extended or adjusted under 35 U.S.C. 154(b) by 0 days.

This patent is subject to a terminal disclaimer.

(21) Appl. No.: 09/575,982

(22) Filed: May 23, 2000

Related U.S. Application Data

(60) Provisional application No. 60/137,507, filed on Jun. 2, 1999.

(51) Int. Cl.[7] ..... H05B 39/00

(52) U.S. Cl. ..... 315/105; 315/291; 315/209 R; 315/DIG. 5

(58) Field of Search ..... 315/246, 209 R, 315/291, DIG. 5, DIG. 2, 105, 94; 313/491, 631, 493, 643

(56) References Cited

U.S. PATENT DOCUMENTS

| | | | | | |
|---|---|---|---|---|---|
| 1,963,963 | A | | 6/1934 | Barclay | 176/124 |
| 2,139,815 | A | | 12/1938 | Fodor | 40/130 |
| 3,235,771 | A | * | 2/1966 | Schwartz | 315/312 |
| 3,801,865 | A | * | 4/1974 | Roberts | 315/276 |
| 3,975,660 | A | | 8/1976 | Knobel et al. | 315/102 |
| 4,005,330 | A | | 1/1977 | Glascock, Jr. et al. | 315/57 |
| 4,010,400 | A | | 3/1977 | Hollister | 315/248 |
| 4,172,981 | A | * | 10/1979 | Smith | 307/66 |
| 4,189,661 | A | | 2/1980 | Haugsjaa et al. | 315/39 |
| 4,196,374 | A | | 4/1980 | Witting | 315/58 |
| 4,266,167 | A | | 5/1981 | Proud et al. | 315/248 |
| 4,373,146 | A | | 2/1983 | Bonazoli et al. | 315/209 R |
| 4,410,930 | A | | 10/1983 | Yachabach | 362/145 |
| 4,420,898 | A | | 12/1983 | Moses | 40/570 |
| 4,427,923 | A | | 1/1984 | Proud et al. | 315/248 |
| 4,461,981 | A | * | 7/1984 | Saikatsu et al. | 315/246 |
| 4,482,809 | A | * | 11/1984 | Maarschalkerweerd | 250/436 |
| 4,544,863 | A | * | 10/1985 | Hashimoto | 315/209 R |
| 4,587,600 | A | | 5/1986 | Morten | 362/219 |
| 4,613,795 | A | * | 9/1986 | Itani et al. | 315/205 |
| 4,630,005 | A | | 12/1986 | Clegg et al. | 331/113 A |
| 4,650,265 | A | | 3/1987 | Holtzman | 339/1 L |
| 4,782,268 | A | | 11/1988 | Fähnrich et al. | 315/200 R |
| 4,798,997 | A | | 1/1989 | Egami et al. | 315/115 |
| 4,808,887 | A | | 2/1989 | Fähnrick et al. | 315/247 |
| 4,857,806 | A | | 8/1989 | Nilssen | 315/72 |

(List continued on next page.)

OTHER PUBLICATIONS

Peter N. Wood and Gerry Limjuco, "Simple Electronic Ballast Using IR2155 MOS Gate Driver", *International Rectifier Publication Application Notes* , No. DT 94–3, pp. 1–11. (Best available copy).

Peter N. Wood, "Electronic Ballasts Using the Cost–Saving IR2155 Driver", *International Rectifier Publication Application Notes* , No. AN–995, pp. 1–3.

*Primary Examiner*—Haissa Philogene
(74) *Attorney, Agent, or Firm*—Jim Zegeer

(57) ABSTRACT

A standard bi-pin, non-thermionic fluorescent lamp comprising a fluorescent envelope having a length selected from about two-, four- and eight-foot lengths and a pair of electrode ends, an electrode mounted in the fluorescent envelope at each electrode end, respectively, a pair of rigid conductive mounting pins secured to each electrode end with at least one of the pins being electrically connected to an electrode, respectively. The electrode is selected from tungsten, copper, molybdenum, carbon steel, and a thin film coating on a dielectric substrate. The lamp is driven by a square wave alternating current driver source having a frequency of between about 75 kHz to about 3.9 MHz connected to the pair of electrodes with a preferred frequency of about 100 kHz. In a preferred embodiment, a pair of said non-thermionic lamps are connected in series across the AC square wave driver.

4 Claims, 2 Drawing Sheets

U.S. PATENT DOCUMENTS

RE33,057 E 9/1989 Clegg et al. ..... 315/224
4,872,980 A * 10/1989 Maarschalkerweerd ..... 250/243
4,920,299 A 4/1990 Presz et al. ..... 315/98
4,949,013 A 8/1990 Zuchtriegel ..... 315/106
4,959,591 A 9/1990 Hirschmann ..... 315/209 R
4,973,885 A 11/1990 Kerwin ..... 315/219
5,023,518 A * 6/1991 Mans et al. ..... 315/219
5,027,032 A * 6/1991 Nilssen ..... 315/103
5,043,627 A * 8/1991 Fox ..... 313/491
5,081,399 A * 1/1992 Jy ..... 315/121
5,140,224 A * 8/1992 Kakitani et al. ..... 315/209 R
5,204,586 A * 4/1993 Moore ..... 315/159
5,230,792 A * 7/1993 Sauska et al. ..... 210/97
5,300,860 A 4/1994 Godyak et al. ..... 315/39
5,324,423 A * 6/1994 Markham ..... 210/87
5,325,024 A 6/1994 Piejak et al. ..... 315/248
5,349,270 A 9/1994 Roll et al. ..... 315/209 R
5,359,263 A 10/1994 Roberts ..... 315/58
5,365,145 A * 11/1994 Fields ..... 315/86
5,381,073 A 1/1995 Godyak et al. ..... 315/58
5,401,394 A * 3/1995 Markham ..... 210/85
5,408,162 A 4/1995 Williams ..... 315/224
5,461,286 A 10/1995 Hirschmann ..... 315/205
5,491,387 A * 2/1996 Saito ..... 315/307
5,503,800 A * 4/1996 Free ..... 422/24
5,512,801 A 4/1996 Nilssen ..... 315/209 R
5,521,467 A 5/1996 Statnic et al. ..... 315/247
5,526,251 A 6/1996 Andre et al. ..... 362/396
5,536,395 A * 7/1996 Kuennen et al. ..... 210/87
5,547,590 A * 8/1996 Szabo ..... 210/748
5,548,189 A 8/1996 Williams ..... 315/224
5,578,907 A 11/1996 Tao et al. ..... 315/247
5,581,161 A 12/1996 Gong ..... 315/307
5,611,163 A 3/1997 Smith ..... 40/570
5,611,918 A * 3/1997 Markham ..... 210/87
5,656,925 A * 8/1997 Schie et al. ..... 323/222
5,666,031 A * 9/1997 Jennato et al. ..... 315/246
5,677,602 A * 10/1997 Paul et al. ..... 315/224
5,698,091 A * 12/1997 Kuennen et al. ..... 210/87
5,707,594 A * 1/1998 Austin ..... 422/186.3
5,710,487 A * 1/1998 Valcke ..... 315/205
5,757,144 A * 5/1998 Nilssen ..... 315/291
5,866,984 A * 2/1999 Doughty et al. ..... 313/643
5,905,339 A * 5/1999 Chow et al. ..... 313/631
5,914,571 A * 6/1999 Beasley ..... 315/244
5,914,843 A * 6/1999 Hopkins et al. ..... 361/42
6,034,485 A * 3/2000 Parra ..... 315/209 R
6,107,756 A * 8/2000 Parra ..... 315/324
6,111,370 A * 8/2000 Parra ..... 315/307
6,144,175 A * 11/2000 Parra ..... 315/307
6,203,172 B1 * 3/2001 Wanuch et al. ..... 362/260

* cited by examiner

NON-THERMIONIC FLUORESCENT LAMPS AND LIGHTING SYSTEMS

REFERENCE TO RELATED APPLICATION

The present application is based on provisional Application No. 60/137,507 filed Jun. 2, 1999 entitled NON-THERMIONIC FLUORESCENT LAMPS AND LIGHTING SYSTEMS.

BACKGROUND AND BRIEF DESCRIPTION OF THE INVENTION

The standard sizes of bi-pin, two-, four- and eight-foot length fluorescent lamps have heated filaments at one or both ends and hence are thermionic. That is, they require heated filaments for operation at relatively high starting voltages. Heated filaments shorten the life of the lamp leading to relamping programs at large installations such as schools, warehouses, factories, large stores, office complexes, etc. These relamping programs periodically replace the fluorescent lamps to avoid decreasing luminous efficiencies because of darkened ends due to sputtering at the filaments, the down time caused by the sporadic failure of and unexpected lamp failures, etc. Moreover, heated filaments radiate heat and cause added air conditioning or cooling expenses in terms of electrical energy usages.

The three major causes of lamp failure are:

1. Filament open (non-functional).
2. Intrusion of metal vapors (from the evaporation of the hot filaments) in the mercury vapor inside the lamp, causing loss of light output, due to diluted concentration of mercury, and eventually flicker.
3. Glass breakage:

Eliminating the first two major causes (eliminating the filament), the tube life could be extended beyond the present use, doubling, tripling, quadrupling or beyond the useful life of the lamp, the intrusion of mercury into the environment due to lamp disposal, will be cut by 50%, 66%, 75% or beyond per year. The annual amount of mercury intrusion on the environment is in excess of 15 billion milligrams of mercury per year.

Ref: 500,000,000 fluorescent lamps disposed yearly at 30 mg of Hg per lamp.

The above is an ever increasing intrusion due to the increasing use of fluorescent lighting.

The object of the present invention is to provide non-thermionic lamps and driver systems which avoid the above-noted problems in the art.

Moreover, prior art fluorescent lamps have a relatively high mercury content which causes disposal/recycling problems for landfills, etc. Another objective of the invention is to provide a fluorescent lamp with substantial increase in lamp life due to the avoidance of filament failure (major cause of relamp/replace) as well as contamination of the gas by evaporating hot filaments. Due to the preservation of the integrity of the gas, lower mercury content in these lamps is contemplated. Even if the mercury content is the same, due to the long lamp life, replacement is significantly reduced, thereby reducing mercury disposal problems.

According to the invention, filamentless electrodes are mounted at the ends of standard lengths fluorescent lighting tube (two, four and eight feet) and have standard, conventional bi-pin mounting arrangement at each end so that conventional fluorescent tube sockets can be used. A low voltage square wave alternating current driver circuit having a frequency in the range of about 75 kHz to about 3.9 MHz is connected to the electrodes to thereby energize the lamp. In a preferred embodiment, a pair of lamps are connected in series across a low voltage square wave alternating current source having a frequency of about 100 kHz.

In my patent application Ser. No. 08/942,670 filed Oct. 2, 1997, I disclose a novel non-thermionic fluorescent lighting system using square wave alternating current drivers.

DESCRIPTION OF THE DRAWINGS

The above and other objects and advantages of the invention will become more apparent when considered with the following specification and accompanying drawings wherein.

DETAILED DESCRIPTION OF THE INVENTION

Figure 1:
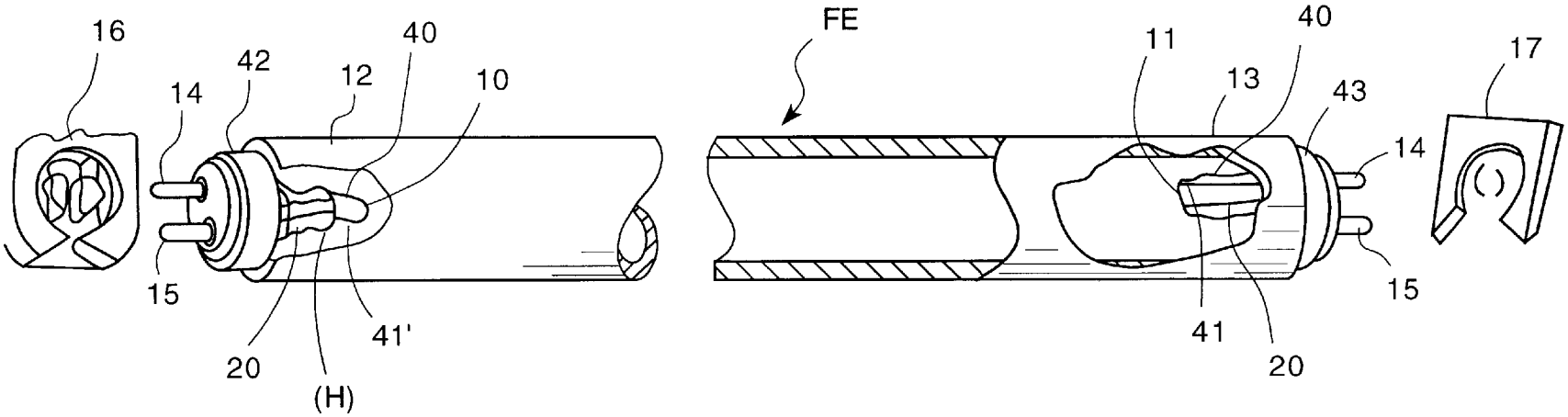
FIG. 1 is a partial sectional view of a standard length (two-, four- or eight-foot length) filamentless fluorescent tubes incorporating the invention.

As shown in FIG. 1 of the drawings, filamentless electrodes 10 and 11 are mounted at the ends 12 and 13 of standard lengths fluorescent envelope FE (as used herein the term "fluorescent envelope" means a hermetically sealed glass or plastic envelope filled with a rare gas and mercury (which is vaporized during operation) which is rich in ultraviolet or UV energy upon ionization thereof and a fluorescent material coated on or incorporated in the glass or plastic envelope) lighting tube (two, four and eight feet) and have conventional bi-pin mounting arrangement constituted by rigid pins 14 and 15, at each end, respectively, so that conventional fluorescent tube sockets 16 and 17, respectively, can be used to mount the tubes in lighting fixtures 18. When driven by the high frequency alternating current square waves, the currents are very small and the electrodes can be thin conductive coatings 19 on a dielectric substrate 20. Thus the electrode material can be selected from tungsten, molybdenum, carbon steel, etc., thin film conductive coatings on dielectric substrates and equivalent materials known in the art. The electrodes 10, 11 are mounted inside the fluorescent envelope by one or more wires 40, 41 which extend through the end fitments 42, 43 and connect electrically to pins 14 and 15. It will be appreciated that, according to the invention, only one pin need be electrically connected to filamentless electrodes 10 and 11.

A low voltage (from about 2 volts to about 90 volts or higher) square wave alternating current driver circuit 21 having a frequency in the range of about 75 KHZ to about 3.9 MHZ is used and applied to the electrodes 10 and 11 and thereby energizing the filamentless lamp 22. In a preferred embodiment, a pair of filamentless 30 and 31 lamps are connected in series across a low voltage square wave alternating current source 21' having a frequency of about 100 kHz.

Figure 3:
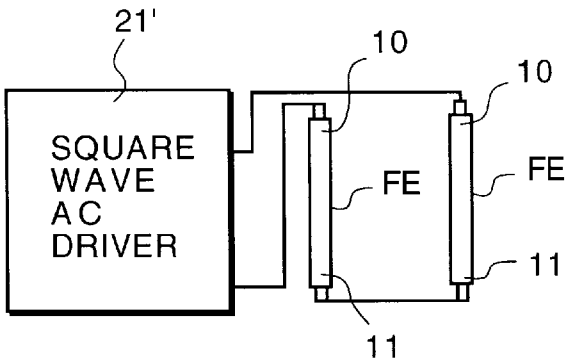
FIG. 3 is a functional block diagram of a further embodiment of the invention and FIG. 4 is an isometric view of a four-tube lighting fixture incorporating the invention.
Figure 2:
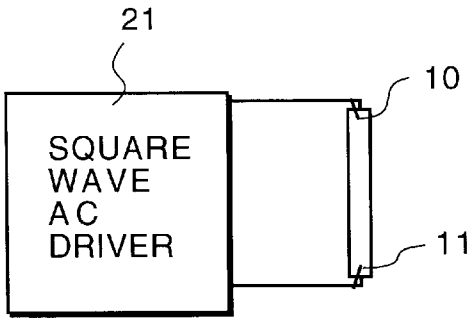
FIG. 2 is a functional block diagram of a fluorescent lighting system incorporating the invention.
Figure 4:
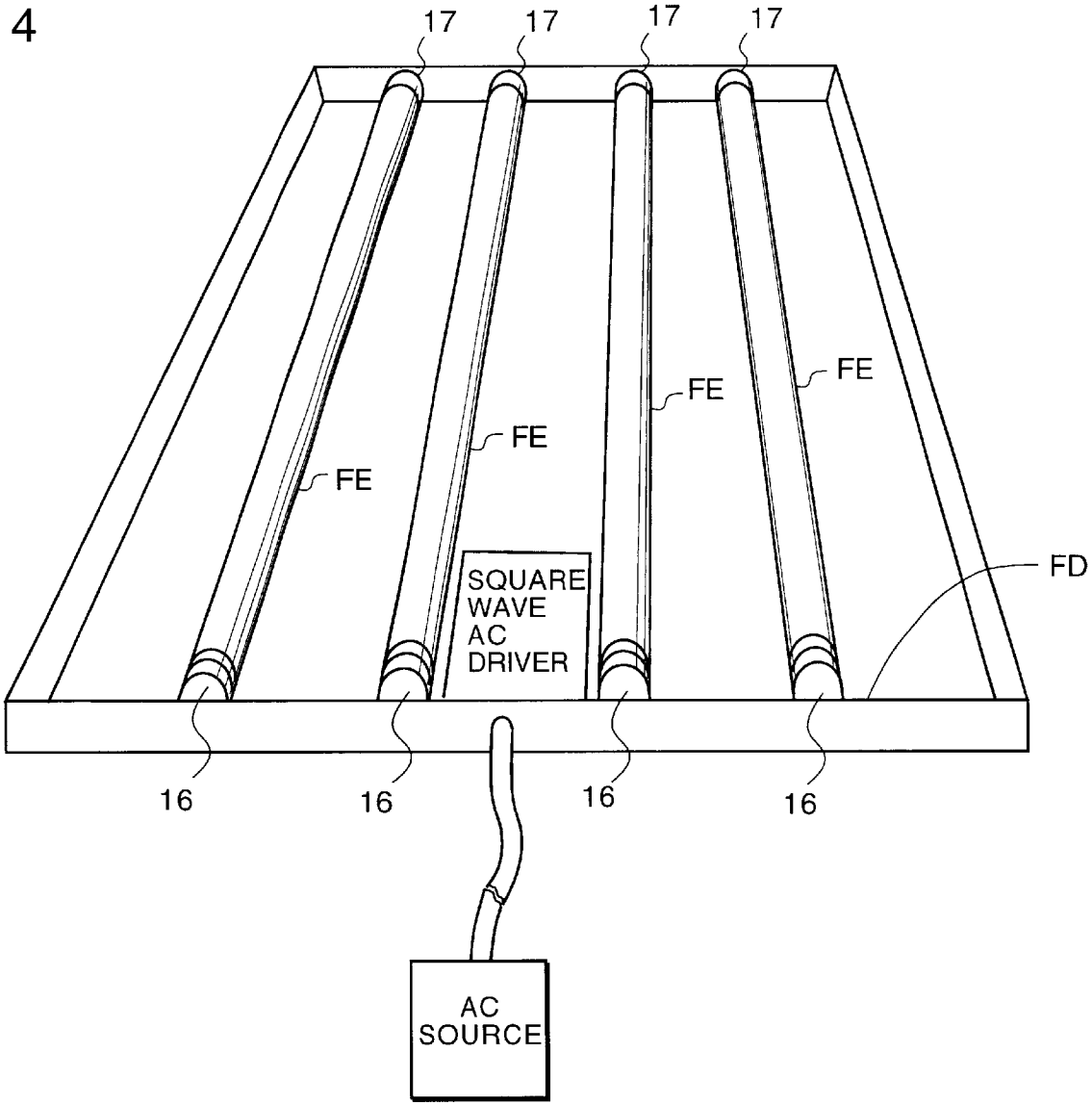

FIG. 4 shows a "trofer" with four tubes FE, with any tube connected in series (FIG. 3), and each series pair, or all four lamps in series, being separately driven by a square wave alternating current driver. A conventional light diffusing panel LD is provided.

While preferred embodiments of the invention have been illustrated and described, it will be appreciated that other embodiments, adaptations, modifications and changes will be readily apparent to those skilled in the art.

What is claimed is:

1. A non-thermionic fluorescent lighting system comprising a plurality of non-thermionic fluorescent lamps each having a length selected from two-, four-, and eight-foot lengths and a pair of electrode ends, an electrode mounted in said fluorescent lamp at each end, respectively, a pair of rigid conductive external mounting pins secured to each electrode end with at least one of said pins being electrically connected to an electrode, respectively, a first wire circuit connecting at least two of said mounting pins in two lamps electrically together so that all said lamps are serially connected leaving a pair of electrode ends and their respective mounting pins free for connection to a high-frequency alternating current driving voltage source for starting and operating all said fluorescent lamps, said high-frequency alternating current driving voltage source having a pair of output terminals, a second wire circuit connecting one of said output terminals to one free electrode end of said plurality of fluorescent lamps and a third wire circuit connecting the other of said output terminals to the remaining free electrode end of said plurality of fluorescent lamps.

2. A lighting system defined in claim 1 wherein said alternating current driving voltage source is a square wave driver source having a frequency of between about 75 kHz to about 3.9 MHz.

3. The lighting system defined to claim 1 wherein said electrodes are selected from copper, molybdenum, carbon steel, and a thin film coating on a dielectric substrate.

4. The lighting system defined in claim 1 wherein said electrode is a thin film coating on a dielectric substrate.

* * * * *